US008316563B2

(12) United States Patent
Wegner

(10) Patent No.: US 8,316,563 B2
(45) Date of Patent: Nov. 27, 2012

(54) SHOE AND INTERCHANGEABLE SHOE COVER SYSTEMS

(76) Inventor: Elizabeth Erika Wegner, Wonder Lake, IL (US)

( * ) Notice: Subject to any disclaimer, the term of this patent is extended or adjusted under 35 U.S.C. 154(b) by 724 days.

(21) Appl. No.: 12/077,197

(22) Filed: Mar. 17, 2008

(65) Prior Publication Data

US 2008/0235993 A1 Oct. 2, 2008

Related U.S. Application Data

(60) Provisional application No. 60/895,282, filed on Mar. 16, 2007.

(51) Int. Cl.
*A43B 3/24* (2006.01)

(52) U.S. Cl. ..... 36/100; 36/7.1 R

(58) Field of Classification Search ..... 36/15, 100, 36/101, 7.1 R, 7.2
See application file for complete search history.

(56) References Cited

U.S. PATENT DOCUMENTS

| | | | | | |
|---|---|---|---|---|---|
| 2,068,946 | A * | 1/1937 | Ferguson | 36/1 |
| 2,099,476 | A * | 11/1937 | Glowka | 36/2 R |
| 2,229,563 | A * | 1/1941 | Greenstein | 36/72 R |
| 2,236,367 | A * | 3/1941 | Gruber | 36/101 |
| 2,261,125 | A * | 11/1941 | McFeely | 36/101 |
| 3,349,504 | A * | 10/1967 | Shearer | 36/100 |
| 3,373,510 | A * | 3/1968 | Memole et al. | 36/100 |
| 4,713,895 | A * | 12/1987 | Vallieres | 36/1.5 |
| 4,850,122 | A * | 7/1989 | Schwab, Jr. | 36/72 R |
| 5,144,759 | A * | 9/1992 | Mascotte | 36/7.1 R |
| 5,311,676 | A * | 5/1994 | Hughes et al. | 36/100 |
| 5,337,491 | A * | 8/1994 | Mascotte | 36/7.1 R |
| 5,544,430 | A * | 8/1996 | Jacko | 36/7.1 R |
| 5,778,564 | A * | 7/1998 | Kettner | 36/101 |
| 2003/0177664 | A1 * | 9/2003 | Monassebian | 36/100 |
| 2005/0066550 | A1 * | 3/2005 | Liu | 36/101 |
| 2006/0032084 | A1 * | 2/2006 | Pang et al. | 36/7.1 R |
| 2008/0092408 | A1 * | 4/2008 | Yeung | 36/101 |
| 2008/0098623 | A1 * | 5/2008 | Komitau | 36/101 |
| 2008/0229615 | A1 * | 9/2008 | Yu | 36/100 |

* cited by examiner

*Primary Examiner* — Marie Patterson

(57) ABSTRACT

Disclosed is a shoe and an interchangeable shoe cover system. The system includes a shoe having an upper with a bottom surface, a sole having an upper surface. One or more slots are defined between the bottom surface of the upper and the upper surface of the sole. The system also includes a shoe cover having at least one rigidly flexible frame member configured to engage with the one or more slots. The shoe cover also includes a cover material portion securely attached to the frame member and that is configured to be extendible into the upper portion of the shoe to secure the cover, as well as pull it taught or tension it over the outer surface of the shoe.

4 Claims, 3 Drawing Sheets

9
1
2
5
3
4
5

5
5
3

6
5
7
8

SHOE AND INTERCHANGEABLE SHOE COVER SYSTEMS

CLAIM OF PRIORITY UNDER 35 U.S.C. §119

The present application for patent claims priority to Provisional Application No. 60/895,282 entitled "Shoes, Belts and Purses with Replaceable Covers" filed Mar. 16, 2007, and is expressly incorporated by reference herein.

BACKGROUND

1. Field

The present disclosure relates to shoes and interchangeable shoe covers and systems, and more particularly to shoes having means to easily enable corresponding interchangeable shoe covers to placed on the shoes to change their appearance.

2. Background

Various shoe systems are known having replaceable or changeable shoe covers are known that enable ease of changing the appearance of a shoe. These known shoe systems include the use of covers that fasten to a sole portion of a shoe and to an upper portion of the shoe using various means.

For example, one known shoe cover system employs a combination of a tapered plate affixed to the underside of the sole portion and wire hems in the cover to hold a shoe cover at one end and an elastic draw cord to affix the cover to upper opening of the shoe at the other end of the cover. Such a system can be somewhat cumbersome to affix and removes covers as it involves the use of an additional plate.

In another known example of a shoe cover system, a shoe cover is affixed to a shoe by either being stretched completely around the sole of the shoe at a portion of one end and by slide fastener around the top edge of the shoe at another end. By stretching the cover over the portion of the sole of the shoe, however, the cover is exposed to increased wear, causing potential tearing. Furthermore, the shoe cover is fastened at the sole portion which is walked upon by a bent metal strip on the shoe that engages with the sole and is bent around the sole for fastening. This arrangement is prone to loosening over time due to metal deformation.

Yet other examples of shoe covers extend fully over a shoe, exposing the cover to wear and tear by essentially making the cover the walking surface of the shoe. Such covers require more material, and more resilient material to ensure a modicum of cover longevity. Such covers, however, are more costly and also become problematic in maintaining a snug, tensioned fit of the cover on the shoe.

Other known prior art attempts using a covering system have numerous disadvantages. One disadvantage is the use of a standard shoe that has no capability of securing the covers without bulky or unsightly features added to make the cover stay in place. This can lead to a poor fitting or unattractive addition to the shoe. Thus, the prior art in that those issues will make the product seem hard to use or unattractive and can become less appealing to purchase or use.

Yet other prior systems used covers that were adhered with adhesive. The disadvantage with such systems is that once adhesive is used, the shoe's appearance is marred, and at that point, a user cannot wear the shoes without a cover adhered. Thus, such prior systems do not afford a shoe or cover having long-term durability.

Accordingly, it would be beneficial to provide a shoe and shoe cover system ensuring that the cover is snugly stretching over the surface of the shoe to avoid wrinkles or slack, while affording ease of change of the cover and minimizing exposure of the cover to wear and tear.

BRIEF DESCRIPTION OF THE DRAWINGS

It is noted that like elements are illustrated in the several views of the drawings and are denoted with the same reference numbers throughout.

DETAILED DESCRIPTION

The present invention relates generally to a shoe manufactured with a securing feature within the section between the upper portion and the lower (sole) portion. This feature solves problems that many prior attempts were unable to achieve.

The combination of this shoe created to work specifically with the covers gives a user the ability to wear the shoes without any cover or to add a cover very easily and this is also very cost effective, as well as helping limit the space that numerous shoes can take up over time. This system afford space savings since the covers are easily stored in a drawer or a small box. This also solves the problem for people who travel, for example. This disclosed system essentially allows the user to bring one shoe on a trip and numerous covers. Thus, the user may effectively bring several colors, prints or textures of shoes without the bulk and weight. This system easily changes the look of the shoe with great ease.

The present invention can be used with many styles of shoes when they are manufactured using the said securing feature. This makes every season and trend easy to translate to a new shoe style or cover style. Again, each shoe is attractive with or without the covering system and that makes the presently disclosed system easy to use for achieving numerous looks and styles.

Figures 1, 2, 3, 4:
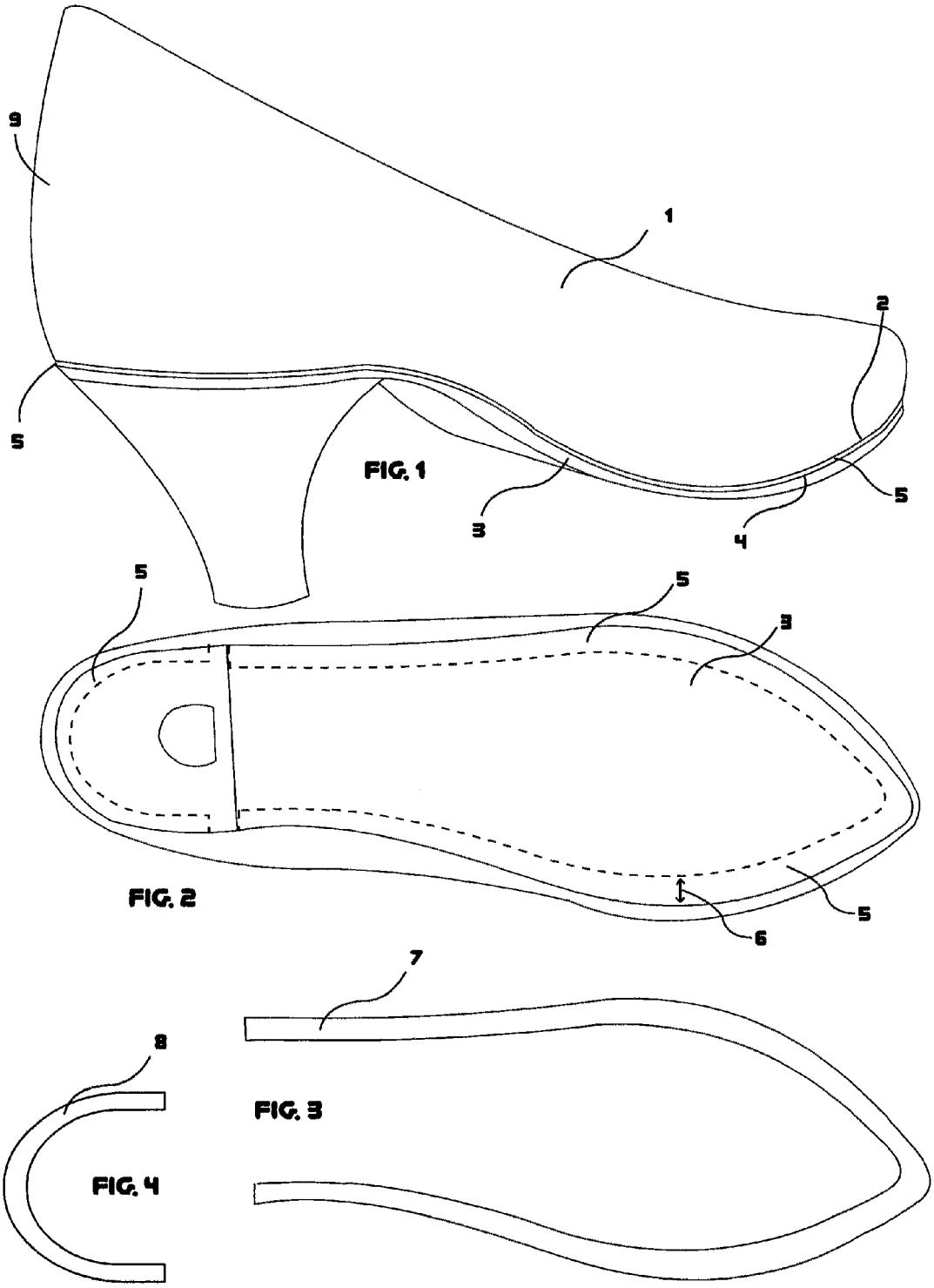
FIG. 1 is an isometric view of a shoe in accordance with the presently disclosure.
FIG. 2 is bottom view of the shoe of FIG. 1.
FIG. 3 illustrates a top view of a rigidly flexible frame member for use with a cover in the presently disclosed system.
FIG. 4 illustrates another example of a second rigidly flexible frame member for use with a cover in the presently disclosed system.

FIG. 1 illustrates shoe for use in the presently disclosed system. The shoe may be constructed of any number of materials including man-made materials, leather or any other material used to make shoes. The shoe includes an upper 1 having a bottom surface 2. The shoe also include a sole portion 3 having an upper surface 4. At least a portion of the bottom surface of the upper 1 and the upper surface of the sole 3 define one or more slots 5 around the circumference of the base (i.e., the junction of the upper 1 and the sole 3), defined between the upper 1 and sole 3 of the shoe. The slot(s) 5 are configured to have sufficient depth for a rigidly flexible frame member in a slip cover (not shown in FIG. 1) to be pushed into, securing itself inside of this slot. The depth of this slot or slots 5 may be determined on what shoe style and security factor is needed. As merely an example, the slots can be from ½" to ¾" into the depth of the shoe surrounding the circumference of the base. In an example, the one or more slots 5 are virtually unseen to the eye when wearing the shoes without the covers. The slots 5 may also include coating on the inner surfaces thereof to ensure waterproofing.

FIG. 2 illustrates a bottom view of the shoe of FIG. 1. As may be seen the one or more slots 5 may extend around the base. Additionally, the slot extends a depth 6 between the upper and the sole 3. The depth, as discussed above, may be any suitable depth to ensure proper securing of a slip cover's frame member.

FIG. 3 illustrates an exemplary top view of rigidly flexible frame member 7 that is used in construction of a slip cover to cover the shoe of FIG. 1. The frame member 7 is of sufficient sizing to engage with the slot 4 of the shoe. In an example, the width of the member 7 is sized to ensure friction with the surfaces of the slot 4 in order to hold the frame member 7 in the slot. Additionally, the frame member 7 may be sized to be congruent in shape to the slot 4, but to also be slightly smaller than the shape of slot 4 to ensure tensioning when engaged with the slot 4. Although FIG. 3 illustrates a particular shape, the shapes envisioned are numerous to adapt to many different shoe styles apart from the style illustrated in FIG. 1.

FIG. 4 illustrates a further aspect of the present system where at least a second rigidly flexible frame member may be used with the cover. In this example, a second member 8 is illustrated that may engage with the slot 5 at a heel portion (See heel portion 9 in FIG. 1).

Figure 5:
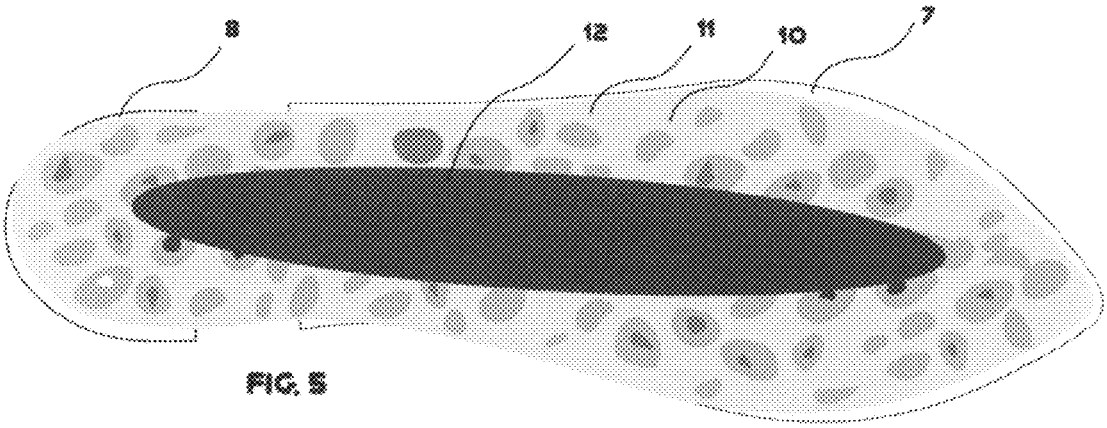
FIG. 5 is a top view of the shoe of a shoe cover using the frame member illustrated in FIGS. 3 and 4.

FIG. 5 illustrates a top view of an assembled slip cover including at least one frame member, such as members 7 or 8. As illustrated the cover include a fabric cover material portion 10, which may include a decorative print (as shown) or texture or material (e.g., suede). Fabric shoe cover that will be sewn or applied in some method (e.g., adhesive) to the frame members (7 or 8). In one example, the cover is sewn into the underside of these frame members so when the frame members are pushed into the slots, the material covers the frame member and the seam of the fabric also gets pushed into the slot as well. This creates a seamless look and is simple for the user to do. The cover material portion 10 is, in an example, comprised of an elastic material.

Additionally, the cover material portion 10 may comprise a contiguous fabric. Furthermore, the contiguous fabric may include a first elastic fabric (11) attached to the frame member (7 or 8), and a second elastic fabric 12 attached to the first elastic fabric 11 and configured to be inserted into the at least a portion of the upper portion 1 of the shoe. It is noted that the portion 12 may be a foot cover made from a hosiery like material which is in the center of the shoe cover (as shown) for an added securing feature and tensioning of the fabric 11 on the outer surface of the upper 1, as well as a comfort feature.

Figure 6:
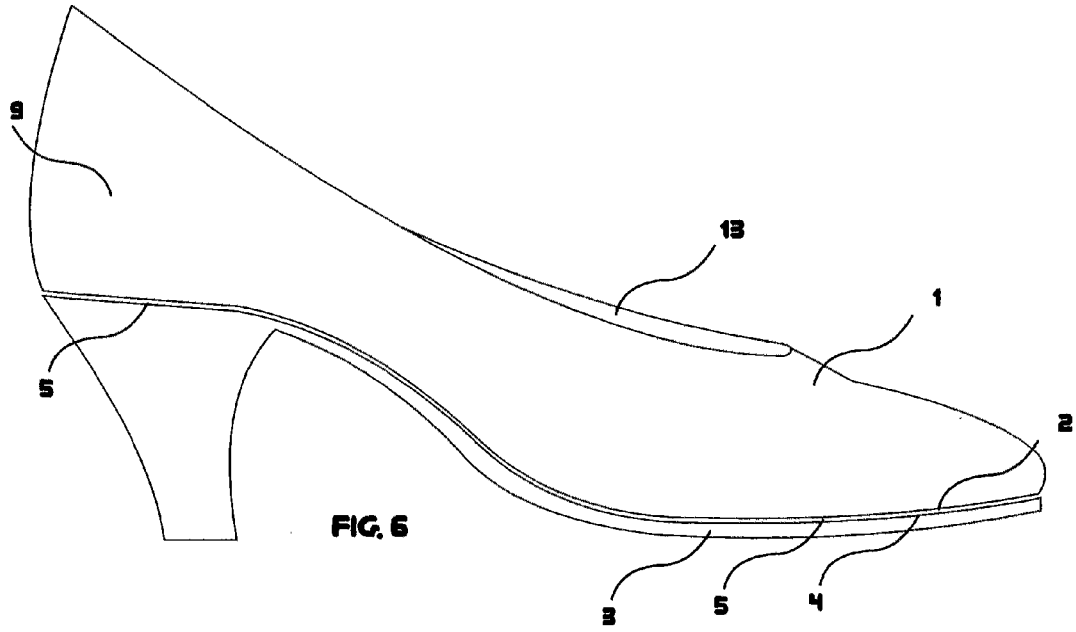
FIG. 6 illustrates a side view of the shoe of FIG. 1.

The side view of FIG. 6 shows the opening portion 13, into which the portion 12 of the cover is inserted. Insertion may be performed by a user placing a foot into the opening 13 defined by the upper 1. Alternatively, an insole (not shown) may be inserted into the opening and engaged with portion 12 to maintain the cover on the shoe and keep tension on the cover as well.

Figure 7:
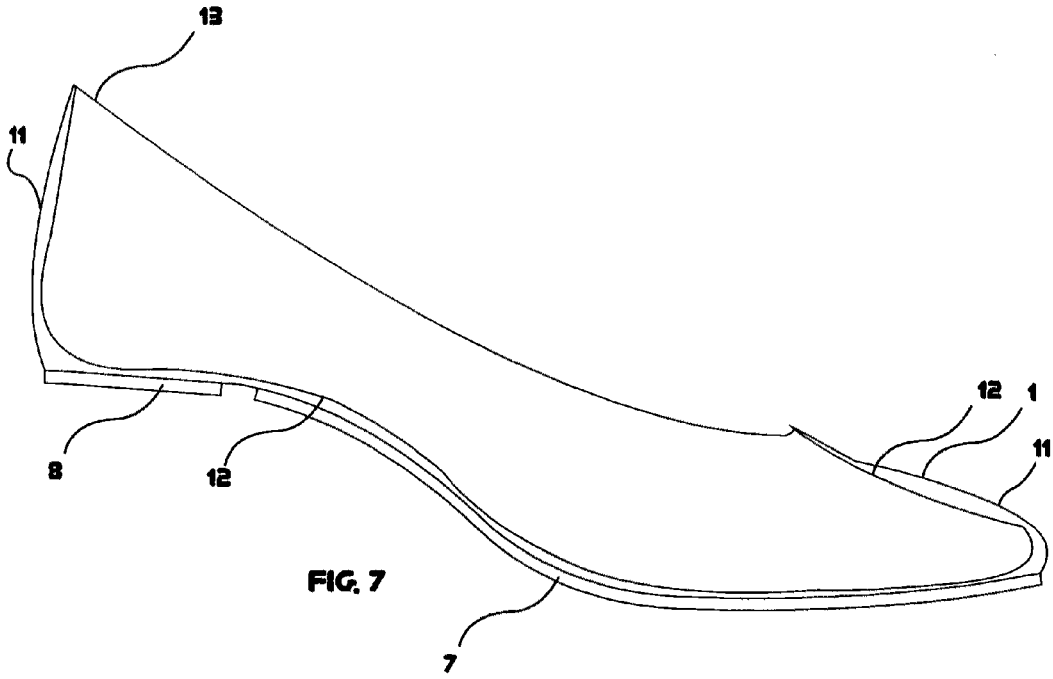
FIG. 7 illustrates a partial cross-sectional side view of the shoe of FIG. 1 with an attached shoe cover.

FIG. 7 illustrates a partial view (i.e., some elements omitted for clarity) of a side cross-section of the shoe. As may be seen, the second portion 12 is inserted into the opening 13 and cavity defined by upper 1. The frame member (7 and 8) is inserted into the slot to secure the cover around the base of the shoe. The first portion 11 of the cover 10 is stretched taught over the outer surface of the upper 1 by placement of a foot (or insole) in opening 13, which will in turn tighten the cover even further. This creates an even custom fit on the shoe and lends to the comfort of the user as well since this material will also act as a barrier from friction between the shoe and the foot of the user. At this point the shoes are dramatically changed in appearance with just a few simple steps. Also the addition of custom insoles will be added to create this taught look while the foot is not in the shoe and also adding to the comfort of the shoe.

Figure 8:
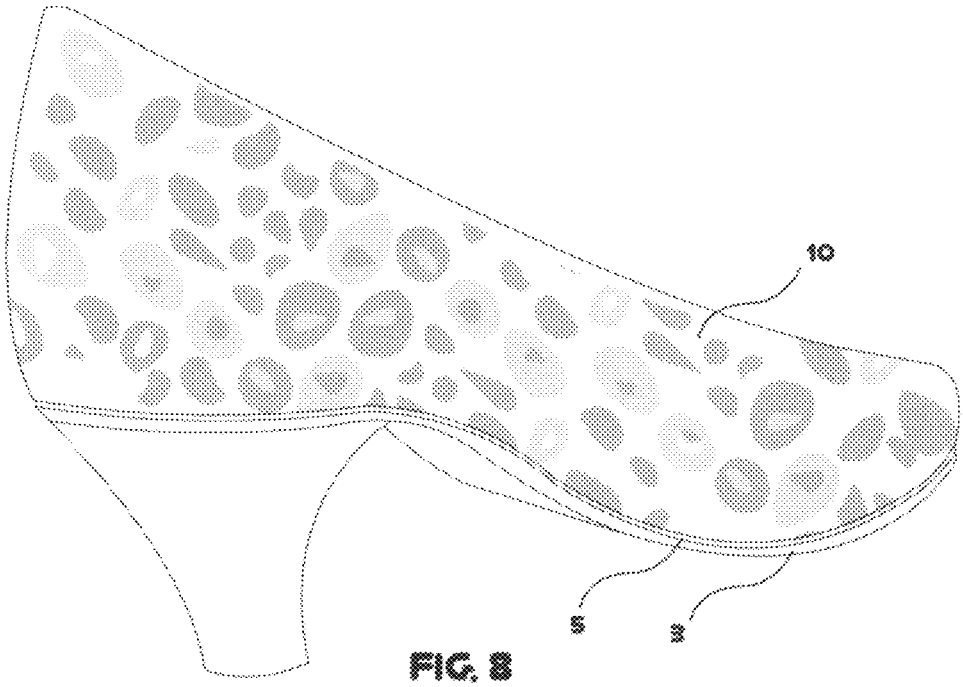
FIG. 8 is an isometric view of the shoe of FIG. 1 with an attached shoe cover.

FIG. 8 illustrates an isometric rear facing view of the shoe with a decorative cover 10 attached to the shoe and tensioned taught.

In operation, one places the cover onto the top of the shoe and simply pushes the cover securing feature (a rigidly flexible securing member) into the slot of the shoe. There is a slight tension in the securing material used on the cover which lends to additional securing without creating additional bulky features. Once the slip is secured within the slots that run the circumference of the shoe, a user is able to easily slide the foot into the shoe and have created a new look for the shoe within moments and without any hassle. The covers have a thin hosiery like material within the center where the foot slides into and which acts in two ways. One way is to create a tight and fully secured outward appearance as well as a great addition of comfort since this material will reduce friction on the foot while being worn, and in turn helping the shoes maintain a high comfort level over long periods of time. This hosiery like material will be thicker than standard hosiery and will be durable and will not run or tear with normal use. The shoes are designed to transform using slip covers ("slips") that can be purchased with the shoes or sold separately. For instance, one slip could be enclosed in the packaging.

In addition to merely the slot dimension adding friction, some further friction inducing material such as a rubberized or plastic type material that could be sewn or "melted into the fabric" (this might help with durability). Essentially, the slip covers the top of the shoe base.

The securing comes into play as the edge of the slip is pushed into the designed separation or slots in the shoe. At that point, the slip is totally secured to the shoe base. In order to provide a seamless look around the inside portion of the shoe, the cover, at the other end, may be provided with flaps of material that can also be sewn or "melted" into the material. These flaps will essentially fold into the shoe itself. This may be a suede or an extremely soft material to lay into the shoe. Before the flaps are put in place inside the shoe, the insole of the shoe can be removed. Note that the insole is removed and the flaps can lay smoothly into the shoe without creating excess bulk. After the flaps are inserted into the shoe, the insole is inserted back into the shoe. The user now then slides their foot into the shoe, thereby holding the flaps in place. Optionally, a high friction material, such as a rubbery type material, can be used on the bottom of the flaps to create an even stronger means of securing the flaps.

The shoe base/heel can take on the appearance of a standard heel, a wedge heel, flat shoe, clog, mule, ankle boot. The possibilities are endless to the styles and shape of the shoes we can create. The heel portion will most likely be made of a man made material.

In another example, the slip or cover may be configured such that rigidly flexible member is made to be seen. The material could be shaped like a "T", as an example. The vertical portion of the T will be pushed into the one more slots of the shoe (circumference). Additionally, the transverse or horizontal portion of the "T" shaped member could be made to look decorative and would also function as another easier option to push the slip into the slot that is in the circumference of the shoe. The horizontal portion of the T would be made of any material, such as leather or plastic and could have beadwork or designs on it.

In another example, the heel of the shoe may be open. A corresponding cover or slip has many options. This slip focuses on the wedge style shoe or any style that can have a heel that can be decorative such as cork, wooden heels, or colors that add style to the shoe. When this slip is created, it is designed to simply lie over the shoe and secure itself (such as by using one of the methods here in). The circumference of the base of the shoe is secured and the heel is left exposed. Many high-heeled shoes like to leave the heel without fabric or print.

In another example, it is contemplated to look at the securing factor in a different way. The slip and the circumference may have a very thin seam sewn around it. This seam will hold a thin elastic string or something with an elastic quality. The slip will lay on the shoe and we still have the slot circumference that was made from the prior securing idea. We use the slot still, but the slip will have one long string inside the seam. This string will be made to loop around itself in the seam of the slip. This would be like a "floating loop" not a fixed knot. The floating loop will prevent the fabric from bunching and will help with the seamless look we are going for. The user will take the slip and lay the slip on to the shoe. Then the slip will have one string at the top back portion of the heel. She will pull the string and when she does this the string will tighten until the seam will be pulled deeply into the slot. The seam will be tightened and secured by the string. The length will be made to be precise so the only portion left after the shoe is secure will be a very small tab. This tab will be made of a flexible clear plastic. Now, this tab needs to be placed somewhere. This is where we take a seam that is already in most shoes and simply deepen that seam. That seam runs vertically along the back middle portion of the heel. We will make that area slightly deeper (using the slot concept) This tab will be slid into that slot. You won't even be able to see it once it is in place and the seam will look like any other seam in a normal heel. This seam secures the circumference of the heel completely. This idea could also be made more decorative by using a self-tightening bead (similar to a coat string pull but very small) along with the tab. The bead will be the tightening feature. The string will be pulled and then the bead slides down to the top back of the heel. Then this bead will rest at the top of the heel like a decorative feature at the back heel. This idea would still use the tab for securing the slip as listed above.

The present invention is, in part, beneficial in that it does not affect the function, style or look of the shoes in any way. The securing features are hidden between layers of the shoes are not easily seen. Thus, the present invention allows the shoe to look normal even when a cover is not being used with shoe, adding to desirability of the shoe with or without the use of the cover, which lends to a completely user-friendly system.

The examples described above are merely exemplary and those skilled in the art may now make numerous uses of, and departures from, the above-described examples without departing from the inventive concepts disclosed herein. Various modifications to these examples may be readily apparent to those skilled in the art, and the generic principles defined herein may be applied to other examples, without departing from the spirit or scope of the novel aspects described herein. Thus, the scope of the disclosure is not intended to be limited to the examples shown herein but is to be accorded the widest scope consistent with the principles and novel features disclosed herein. It is also noted that the disclosed examples are necessarily to be construed as preferred or advantageous over other examples. Accordingly, the novel aspects described herein are to be defined solely by the scope of the following claims.

What is claimed is:

1. A shoe and interchangeable shoe cover system comprising:

A shoe including:

An upper having a bottom surface, and which forms a foot cavity, a sole having an upper surface, where the bottom surface of the upper is disposed on the upper surface of the sole, a continuous slot defined between the bottom surface of the upper and the upper surface of the sole, A shoe cover comprising:

At least one rigidly flexible frame member configured to engage with the continuous slot, a cover material having a first portion which has a bottom edge which is securely attached to the frame member, and a second portion extending from the first portion at a location opposite from the bottom edge, the second portion shaped and sized to extend into and fit inside the foot cavity of the shoe upper, wherein the cover is secured to the shoe by inserting the frame into the slot and the second portion is tensioned by a wearers foot being placed within the cavity of the upper.

2. The shoe and interchangeable shoe cover system as in claim 1 further comprising of a plurality of covers.

3. The shoe and interchangeable cover as defined in claim 1 wherein the frame member includes at least two member pieces.

4. The shoe and interchangeable cover as defined in claim 1 where the cover material portion is comprised of an elastic material.

* * * * *